US010788168B2

(12) United States Patent
Petluri et al.

(10) Patent No.: US 10,788,168 B2
(45) **Date of Patent: *Sep. 29, 2020**

(54) MULTIZONE MIXING CUP

(71) Applicant: Ecosense Lighting Inc., Los Angeles, CA (US)

(72) Inventors: Raghuram L.V. Petluri, Los Angeles, CA (US); Paul Kenneth Pickard, Los Angeles, CA (US)

(73) Assignee: Ecosense Lighting Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/780,093

(22) Filed: Feb. 3, 2020

(65) Prior Publication Data

US 2020/0173614 A1 Jun. 4, 2020

Related U.S. Application Data

(63) Continuation of application No. 16/048,246, filed on Jul. 28, 2018, now Pat. No. 10,551,010, which is a continuation of application No. PCT/US2016/066699, filed on Dec. 14, 2016.

(60) Provisional application No. 62/288,368, filed on Jan. 28, 2016.

(51) Int. Cl.

| | |
|---|---|
| ***F21K 9/62*** | (2016.01) |
| ***F21V 7/09*** | (2006.01) |
| ***F21K 9/64*** | (2016.01) |
| ***F21Y 115/10*** | (2016.01) |

(52) U.S. Cl.

CPC ..... *F21K 9/62* (2016.08); *F21K 9/64* (2016.08); *F21V 7/09* (2013.01); *F21Y 2115/10* (2016.08)

(58) Field of Classification Search

CPC ..... F21V 9/30; F21V 9/32; F21V 9/38; F21K 9/62; F21K 9/64

See application file for complete search history.

(56) References Cited

U.S. PATENT DOCUMENTS

| | | | | |
|---|---|---|---|---|
| D566,323 | S | 4/2008 | Piepgras et al. | |
| D683,493 | S | 5/2013 | Villamizar et al. | |
| 8,556,438 | B2 * | 10/2013 | McKenzie | H05B 45/20 362/84 |
| D731,702 | S | 6/2015 | Ye et al. | |
| 9,116,387 | B2 | 8/2015 | Shimizu | |

(Continued)

FOREIGN PATENT DOCUMENTS

WO WO 2017/131693 A1 8/2017

OTHER PUBLICATIONS

International Patent Application No. PCT/US2016/066699; Int'l Search Report and the Written Opinion; dated Mar. 22, 2017; 10 pages.

(Continued)

*Primary Examiner* — Alexander K Garlen
(74) *Attorney, Agent, or Firm* — FisherBroyles LLP

(57) ABSTRACT

A zoned optical cup which mixes multiple channels of light to form a blended output, the device having discreet zones or channels including a plurality of reflective cavities each having a domed light converting appliance (DLCA) covering a cluster of LEDs providing a channel of light which is reflected upward by the cavities and mixed by angles walls and structures above the open top of the cavities in the common body of the cup.

21 Claims, 6 Drawing Sheets

(56) References Cited

U.S. PATENT DOCUMENTS

| | | | | |
|---|---|---|---|---|
| 9,523,480 | B2 | 12/2016 | Smith | |
| 2005/0138852 | A1 | 6/2005 | Yamauchi | |
| 2007/0223219 | A1* | 9/2007 | Medendorp, Jr. .. | C09K 11/7421 362/231 |
| 2008/0106887 | A1* | 5/2008 | Salsbury | F21K 9/64 362/84 |
| 2009/0080209 | A1 | 3/2009 | Hu | |
| 2011/0031894 | A1* | 2/2011 | Van De Ven | F21K 9/00 315/294 |
| 2011/0222277 | A1* | 9/2011 | Negley | H01L 33/504 362/235 |
| 2012/0051028 | A1 | 3/2012 | Montagne | |
| 2012/0069562 | A1 | 3/2012 | Singer et al. | |
| 2012/0287624 | A1 | 11/2012 | Harbers | |
| 2012/0300452 | A1 | 11/2012 | Harbers et al. | |
| 2013/0114242 | A1* | 5/2013 | Pickard | H05B 45/00 362/84 |
| 2013/0201676 | A1 | 8/2013 | Weaver | |
| 2013/0229785 | A1 | 9/2013 | Harbers | |
| 2014/0092580 | A1 | 4/2014 | McCollum | |
| 2014/0211467 | A1 | 7/2014 | Yang et al. | |
| 2014/0268631 | A1 | 9/2014 | Pickard et al. | |
| 2014/0268728 | A1* | 9/2014 | Hussell | F21K 9/90 362/225 |

OTHER PUBLICATIONS

International Patent Application No. PCT/US2016/066699; Int'l Preliminary Report on Patentability; dated Aug. 9, 2018; 9 pages.

* cited by examiner

MULTIZONE MIXING CUP

CROSS-REFERENCE TO RELATED APPLICATIONS

This patent application is a continuation of U.S. patent application Ser. No. 16/048,246 filed Jul. 28, 2018, which is a continuation of International Patent Application no. PCT/US2016/066699 filed Dec. 14, 2016, which claims priority to Provisional patent application 62/288,368 filed Jan. 28, 2016, the disclosures of which are incorporated by reference in their entirety.

FIELD

A reflecting system and apparatus to blend and mix specific wavelength light emitting diode illumination.

BACKGROUND

A wide variety of light emitting devices are known in the art including, for example, incandescent light bulbs, fluorescent lights, and semiconductor light emitting devices such as light emitting diodes ("LEDs").

White light may be produced by utilizing one or more luminescent materials such as phosphors to convert some of the light emitted by one or more LEDs to light of one or more other colors. The combination of the light emitted by the LEDs that is not converted by the luminescent material(s) and the light of other colors that are emitted by the luminescent material(s) may produce a white or near-white light.

The luminescent materials such as phosphors, to be effective at absorbing light, must be in the path of the emitted light. Phosphors placed at the chip level will be in the path of substantially all of the emitted light, however they also are exposed to more heat than a remotely placed phosphor. Because phosphors are subject to thermal degradation by separating the phosphor and the chip thermal degradation can be reduced. Separating the phosphor from the LED has been accomplished via the placement of the LED at one end of a reflective chamber and the placement of the phosphor at the other end. Traditional LED reflector combinations are very specific on distances and ratio of angle to LED and distance to remote phosphor or they will suffer from hot spots, thermal degradation, and uneven illumination. It is therefore a desideratum to provide a LED and reflector with remote photoluminescence materials that does not suffer from these drawbacks.

DISCLOSURE

Devices, systems, and methods are disclosed herein directed to aspects of zoned illumination including a common body with multiple reflective cavities, each cavity having an open bottom and an open top which terminates below the top of the common body; a common interior annular wall above the open tops; a plurality of domed lumo converting appliance (DLCA) with open bottoms; and, wherein a DLCA is affixed within the open bottom of each reflective cavity. In some instances one or more portions of each open top meet the common interior annular wall at a connection. In some instances angled light mixing members are formed between connections. A diffuser may be affixed to the open top of the unit Devices, systems, and methods are disclosed herein directed to aspects of zoned illumination including a common body with multiple reflective cavities, each cavity having an open bottom and an open top which terminates below the top of the common body; a common interior annular wall at least partially above the open tops; a plurality of domed lumo converting appliance (DLCA) with open bottoms; and, wherein a DLCA is affixed within the open bottom of each reflective cavity. A shared internal top adjacent to the open tops and in some instance that shared top is reflective.

Devices, systems, and methods are disclosed herein directed to aspects of zoned illumination including a common body with multiple reflective cavities, each cavity having an open bottom and an open top which terminates below the top of the common body and each cavity has a complex annular wall structure comprising multiple partial walls with different curvatures and angles; a common interior annular wall at least partially above the open tops; a plurality of domed lumo converting appliance (DLCA) with open bottoms; and, wherein a DLCA is affixed within the open bottom of each reflective cavity. A shared internal top adjacent to the open tops and in some instance that shared top is reflective. In some instance the reflective cavity wall is comprised of at least two sections and each wall section is a partial frustoconical, ellipsoidal or paraboloidal generally conical with a decreased radius near the open bottom compared to the open top.

In some exemplary implementations the zoned illumination device forms a unit for light mixing and blending and each domed lumo converting appliance (DLCA) contains photoluminescence materials including but not limited to phosphors and quantum dots.

Devices, systems, and methods are disclosed herein directed to aspects of zoned illumination including an unitary body with multiple reflective cavities, each cavity having an open bottom and an open top which terminates below the top of the body; a common interior annular wall above the open tops; a plurality of domed lumo converting appliance (DLCA) with open bottoms; wherein a DLCA is affixed at an interface within the open bottom of each reflective cavity; and, wherein each open top meet the common interior annular wall at a connection. In some instances the system further comprises angled light mixing members between connections. In some instance the system further comprising at least one light mixing ribs (LMR) spanning from the shared internal top through the light mixing member and attached to a portion of the common interior annular wall. In some instances the system further comprises both angled light mixing members between connections and at least one light mixing ribs (LMR) spanning from the shared internal top through the light mixing member and attached to a portion of the common interior annular wall.

In some exemplary implementations the zoned illumination system forms a unit for light mixing and blending and each domed lumo converting appliance (DLCA) contains photoluminescence materials including but not limited to phosphors and quantum dots.

Methods are disclosed herein directed to aspects of zoned illumination including placing a common body with multiple reflective cavities, each cavity having a domed lumo converting appliance (DLCA) with open bottoms affixed at the bottom of the cavity; each reflective cavity having an open top which terminates below the top of the common body; a common interior annular wall above the open tops; placing a LED or LED cluster within the open bottom of each DLCA; producing a specific wavelength illumination from each LED or LED cluster; and, providing an altered wavelength light from each LED as the specific wavelength light passes through the DLCA.

In some exemplary implementations the method includes reflecting the altered wavelength light from at least two DLCAs off an angled light mixing member forming a first mixed light. In some exemplary implementations the method includes reflecting the altered wavelength light from at least two DLCAs off a common interior annular wall thereby forming a second mixed light. In some exemplary implementations the method includes reflecting the altered wavelength light from at least one DLCAs off a light mixing rib 320 forming a third mixed light.

DRAWINGS

The disclosure, as well as the following further disclosure, is best understood when read in conjunction with the appended drawings. For the purpose of illustrating the disclosure, there are shown in the drawings exemplary implementations of the disclosure; however, the disclosure is not limited to the specific methods, compositions, and devices disclosed. In addition, the drawings are not necessarily drawn to scale. In the drawings.

Figure 1:
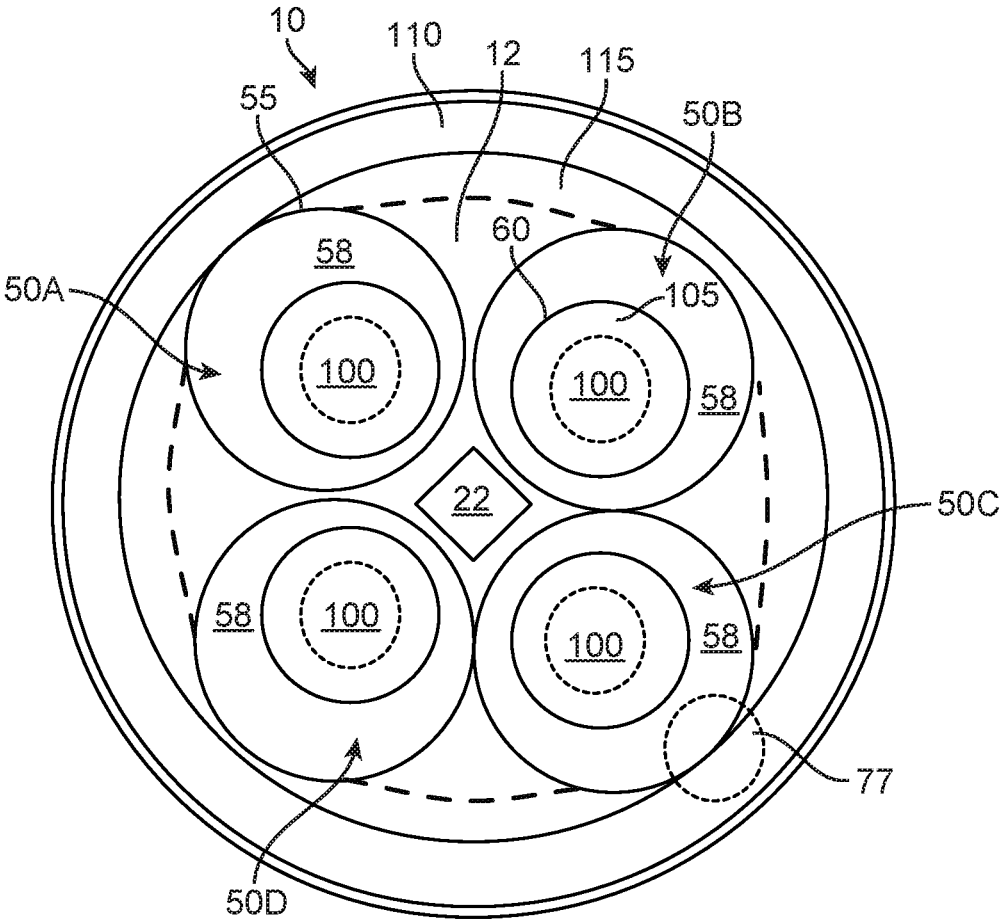
FIG. 1 illustrates a top view of a zoned optical cup (ZOC) with a common reflective body having a plurality of cavities with domed lumo converting appliances (DLCAs) over LEDs.

The general disclosure and the following further disclosure are exemplary and explanatory only and are not restrictive of the disclosure, as defined in the appended claims. Other aspects of the present disclosure will be apparent to those skilled in the art in view of the details as provided herein. In the figures, like reference numerals designate corresponding parts throughout the different views. All callouts and annotations are hereby incorporated by this reference as if fully set forth herein.

FURTHER DISCLOSURE

Light emitting diode (LED) illumination has a plethora of advantages over incandescent to fluorescent illumination. Advantages include longevity, low energy consumption, and small size. White light is produced from a combination of LEDs utilizing phosphors to convert the wavelengths of light produced by the LED into a preselected wavelength or range of wavelengths.

Lighting units disclosed herein have shared internal tops, a common interior annular wall, and a plurality of reflective cavities. The multiple cavities form a unified body and provide for close packing of the cavities to provide a small reflective unit to mate with a work piece having multiple LED sources or channels which provide wavelength specific light directed through domed lumo converting appliances (DLCAs) and then blending the output of the DLACs in the upper portion of the unit via the angled walls and/or the common interior annular wall prior to the light exiting the top of the unit.

Figure 2:
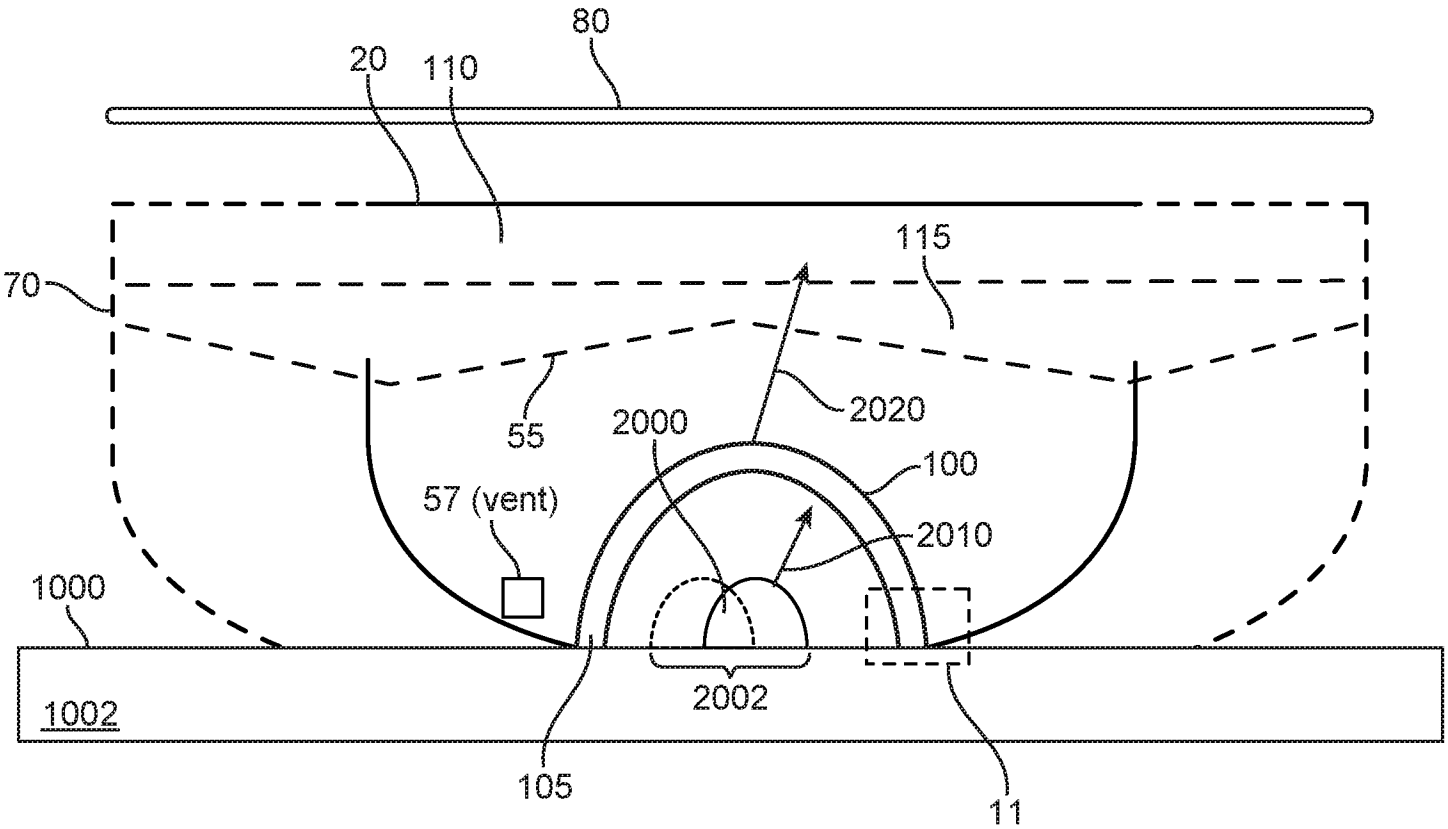
FIG. 2 illustrates a cutaway view of a cavity with DLCA within a zoned optical cup (ZOC).

FIGS. 1 and 2 illustrate aspects of a reflective unit 10 on a work piece 1000 with a top surface 1002. The unit has a shared internal top 12 formed at the level in the unit of the open tops 55, a common open unit top 13, and a plurality of cavities 50A-D. Each cavity has an open top 55 which is open within the reflective unit but below the unit top 13. The unit may have one or more vents 57, and an open bottom 60. The multiple cavities form a unified body and provide for close packing of the cavities to provide a small reflective unit. The open bottoms 60 are positioned over light emitting diodes (LEDs) 2000 which may be placed in clusters 2002. The cavities reflect light towards the open top. Above the open tops is a common interior annular wall or partial walls which reflect light to bend and or mix as it travels toward the top of the unit. Selected domed lumo converting appliances (DLCAs) 100 are placed over the LEDs/LED clusters 2000/2002 wherein the light emitted by the LED is selected via passing it through photoluminescence materials. The DLCA is preferably mounted to the open bottom 60 of a reflective cavity at an interface 11 wherein the open bottom 105 forms a boundary rim of the DLCA 100 is attached via adhesive, snap fit, friction fit, sonic weld or the like to the open bottom 60 of the cavity 50. In some instance the DLCAs are detachable.

The LED or LED cluster 2000/2002 produces a specific wavelength illumination 2010. For a blue LED that wavelength is generally 452 nm. When the specific wavelength LED illumination 2010 passes through the DLCA a portion of it exits altered wavelengths 2020 because of the interaction with the photoluminescence materials.

Depending on intended use there may be instances wherein a DLCA is mounted to a work piece top surface 1002 and the reflective unit 10 is mounted thereover and such a mounting and separation are within the scope of some exemplary implementations disclosed herein. The photoluminescence materials associated with LCAs 100 are used to select the wavelength of the light exiting the LCA. Photoluminescence materials include an inorganic or organic phosphor, silicate-based phosphors, aluminate-based phosphors, aluminate-silicate phosphors, nitride phosphors, sulfate phosphor, oxy-nitrides and oxy-sulfate phosphors, or garnet materials including luminescent materials such as those disclosed in co-pending application PCT/US2016/015318 filed Jan. 28, 2016, entitled "Compositions for LED Light Conversions," the entirety of which is hereby incorporated by this reference as if fully set forth herein. The phosphor materials are not limited to any specific examples and can include any phosphor material known in the art. Quantum dots are also known in the art. The color of light produced is from the quantum confinement effect associated with the nano-crystal structure of the quantum dots. The energy level of each quantum dot relates directly to the size of the quantum dot.

In some implementations of the present disclosure, luminophoric mediums can be provided with combinations of two types of luminescent materials. The first type of luminescent material emits light at a peak emission between about 515 nm and about 590 nm in response to the associated LED string emission. The second type of luminescent material emits at a peak emission between about 590 nm and about 700 nm in response to the associated LED string emission. In some instances, the luminophoric mediums disclosed herein can be formed from a combination of at least one luminescent material of the first and second types described in this paragraph. In implementations, the luminescent materials of the first type can emit light at a peak emission at about 515 nm, 525 nm, 530 nm, 535 nm, 540 nm, 545 nm, 550 nm, 555 nm, 560 nm, 565 nm, 570 nm, 575 nm, 580 nm, 585 nm, or 590 nm in response to the associated LED string emission. In preferred implementations, the luminescent materials of the first type can emit light at a peak emission between about 520 nm to about 555 nm. In implementations, the luminescent materials of the second type can emit light at a peak emission at about 590 nm, about 595 nm, 600 nm, 605 nm, 610 nm, 615 nm, 620 nm, 625 nm, 630 nm, 635 nm, 640 nm, 645 nm, 650 nm, 655 nm, 670 nm, 675 nm, 680 nm, 685 nm, 690 nm, 695 nm, or 670 nm in response to the associated LED string emission. In preferred implementations, the luminescent materials of the first type can emit light at a peak emission between about 600 nm to about 670 nm. Some exemplary luminescent materials of the first and second type are disclosed elsewhere herein and referred to as Compositions A-F.

In some implementations, the luminescent materials of the present disclosure may comprise one or more phosphors comprising one or more of the following materials: $BaMg_2Al_{16}O_{27}:Eu^{2+}$, $BaMg_2Al_{16}O_{27}:Eu^{2+},Mn^{2+}$, $CaSiO_3$:Pb,Mn, $CaWO_4$:Pb, $MgWO_4$, $Sr_5Cl(PO_4)_3:Eu^{2+}$, $Sr_2P_2O_7:Sn^{2+}$, $Sr_6P_5BO_{20}$:Eu, $Ca_5F(PO_4)_3$:Sb, $(Ba,Ti)_2P_2O_7$:Ti, $Sr_5F(PO_4)_3$:Sb,Mn, $(La,Ce,Tb)PO_4$:Ce,Tb, $(Ca,Zn,Mg)_3(PO_4)_2$:Sn, $(Sr,Mg)_3(PO_4)_2$:Sn, $Y_2O_3:Eu^{3+}$, $Mg_4(F)GeO_6$:Mn, $LaMgAl_{11}O_{19}$:Ce, $LaPO_4$:Ce, $SrAl_{12}O_{19}$:Ce, $BaSi_2O_5$:Pb, $SrB_4O_7$:Eu, $Sr_2MgSi_2O_7$:Pb, $Gd_2O_2S$:Tb, $Gd_2O_2S$:Eu, $Gd_2O_2S$:Pr, $Gd_2O_2S$:Pr,Ce,F, $Y_2O_2S$:Tb, $Y_2O_2S$:Eu, $Y_2O_2S$:Pr, Zn(0.5)Cd(0.4)S:Ag, Zn(0.4)Cd(0.6)S:Ag, $Y_2SiO_5$:Ce, $YAlO_3$:Ce, $Y_3(Al,Ga)_5O_{12}$:Ce, CdS:In, ZnO:Ga, ZnO:Zn, (Zn,Cd)S:Cu,Al, ZnCdS:Ag,Cu, ZnS:Ag, ZnS:Cu, NaI:Tl, CsI:Tl, $^6$LiF/ZnS:Ag, $^6$LiF/ZnS:Cu,Al,Au, ZnS:Cu,Al, ZnS:Cu,Au,Al, $CaAlSiN_3$:Eu, $(Sr,Ca)AlSiN_3$:Eu, $(Ba,Ca,Sr,Mg)_2SiO_4$:Eu, $Lu_3Al_5O_{12}$:Ce, $Eu^{3+}(Gd_{0.9}Y_{0.1})_3Al_5O_{12}:Bi^{3+},Tb^{3+}$, $Y_3Al_5O_{12}$:Ce, $(La,Y)_3Si_6N_{11}$:Ce, $Ca_2AlSi_3O_2N_5:Ce^{3+}$, $Ca_2AlSi_3O_2N_5:Eu^{2+}$, $BaMgAl_{10}O_{17}$:Eu, $Sr_5(PO_4)_3Cl$:Eu, $(Ba,Ca,Sr,Mg)_2SiO_4$:Eu, $Si_{6-z}Al_zN_{8-z}O_z$:Eu (wherein $0<z\leq4.2$); $M_3Si_6O_{12}N_2$:Eu (wherein M=alkaline earth metal element), $(Mg,Ca,Sr,Ba)Si_2O_2N_2$:Eu, $Sr_4Al_{14}O_{25}$:Eu, $(Ba,Sr,Ca)Al_2O_4$:Eu, $(Sr,Ba)Al_2Si_2O_8$:Eu, $(Ba,Mg)_2SiO_4$:Eu, $(Ba,Sr,Ca)_2(Mg,Zn)Si_2O_7$:Eu, $(Ba,Ca,Sr,Mg)_9(Sc,Y,Lu,Gd)_2(Si,Ge)_6O_{24}$:Eu, $Y_2SiO_5$:CeTb, $Sr_2P_2O_7$—$Sr_2B_2O_5$:Eu, $Sr_2Si_3O_8$-$2SrCl_2$:Eu, $Zn_2SiO_4$:Mn, $CeMgAl_{11}O_{19}$:Tb, $Y_3Al_5O_{12}$:Tb, $Ca_2Y_8(SiO_4)_6O_2$:Tb, $La_3Ga_5SiO_{14}$:Tb, $(Sr,Ba,Ca)Ga_2S_4$:Eu,Tb,Sm, $Y_3(Al,Ga)_5O_{12}$:Ce, $(Y,Ga,Tb,La,Sm,Pr,Lu)_3(Al,Ga)_5O_{12}$:Ce, $Ca_3Sc_2Si_3O_{12}$:Ce, $Ca_3(Sc,Mg,Na,Li)_2Si_3O_{12}$:Ce, $CaSc_2O_4$:Ce, Eu-activated β-Sialon, $SrAl_2O_4$:Eu, $(La,Gd,Y)_2O_2S$:Tb, $CeLaPO_4$:Tb, ZnS:Cu,Al, ZnS:Cu,Au,Al, $(Y,Ga,Lu,Sc,La)BO_3$:Ce,Tb, $Na_2Gd_2B_2O_7$:Ce,Tb, $(Ba,Sr)_2(Ca,Mg,Zn)B_2O_6$:K,Ce,Tb, $Ca_8Mg(SiO_4)_4Cl_2$:Eu,Mn, $(Sr,Ca,Ba)(Al,Ga,In)_2S_4$:Eu, $(Ca,Sr)_8(Mg,Zn)(SiO_4)_4Cl_2$:Eu,Mn, $M_3Si_6O_9N_4$:Eu, $Sr_5Al_5Si_{21}O_2N_{35}$:Eu, $Sr_3Si_{13}Al_3N_{21}O_2$:Eu, $(Mg,Ca,Sr,Ba)_2Si_5N_8$:Eu, $(La,Y)_2O_2S$:Eu, $(Y,La,Gd,Lu)_2O_2S$:Eu, $Y(V,P)O_4$:Eu, $(Ba,Mg)_2SiO_4$:Eu,Mn, $(Ba,Sr,Ca,Mg)_2SiO_4$:Eu,Mn, $LiW_2O_8$:Eu, $LiW_2O_8$:Eu,Sm, $Eu_2W_2O_9$, $Eu_2W_2O_9$:Nb and $Eu_2W_2O_9$:Sm, (Ca,Sr)S:Eu, $YAlO_3$:Eu, $Ca_2Y_8(SiO_4)_6O_2$:Eu, $LiY_9(SiO_4)_6O_2$:Eu, $(Y,Gd)_3Al_5O_{12}$:Ce, $(Tb,Gd)_3Al_5O_{12}$:Ce, $(Mg,Ca,Sr,Ba)_2Si_5(N,O)_8$:Eu, $(Mg,Ca,Sr,Ba)Si(N,O)_2$:Eu, $(Mg,Ca,Sr,Ba)AlSi(N,O)_3$:Eu, $(Sr,Ca,Ba,Mg)_{10}(PO_4)_6Cl_2$:Eu, Mn, Eu, $Ba_3MgSi_2O_8$:Eu,Mn, $(Ba,Sr,Ca,Mg)_3(Zn,Mg)Si_2O_8$:Eu, Mn, $(k-x)MgO.xAF_2.GeO_2:yMn^{4+}$ (wherein k=2.8 to 5, x=0.1 to 0.7, y=0.005 to 0.015, A=Ca, Sr, Ba, Zn or a mixture thereof), Eu-activated α-Sialon, $(Gd,Y,Lu,La)_2O_3$:Eu, Bi, $(Gd,Y,Lu,La)_2O_2S$:Eu,Bi, $(Gd,Y,Lu,La)VO_4$:Eu, Bi, $SrY_2S_4$:Eu,Ce, $CaLa_2S_4$:Ce,Eu, $(Ba,Sr,Ca)MgP_2O_7$:Eu, Mn, $(Sr,Ca,Ba,Mg,Zn)_2P_2O_7$:Eu,Mn, $(Y,Lu)_2WO_6$:Eu,Ma, $(Ba,Sr,Ca)_xSi_yN_z$:Eu,Ce (wherein x, y and z are integers equal to or greater than 1),$(Ca,Sr,Ba,Mg)_{10}(PO_4)_6(F,Cl,Br,OH)$:Eu,Mn, $((Y,Lu,Gd,Tb)_{1-x-y}Sc_xCe_y)_2(Ca,Mg)(Mg,Zn)_{2+r}Si_{z-q}Ge_qO_{12+\delta}$, $SrAlSi_4N_7$, $Sr_2Al_2Si_9O_2N_{14}$:Eu, $M^1{}_aM^2{}_bM^3{}_cO_d$ (wherein $M^1$=activator element including at least Ce, $M^2$=bivalent metal element, $M^3$=trivalent metal element, $0.0001\leq a\leq0.2$, $0.8\leq b\leq1.2$, $1.6\leq c\leq2.4$ and $3.2\leq d\leq4.8$), $A_{2+x}M_yMn_zF_n$ (wherein A=Na and/or K; M=Si and Al, and $-1\leq x\leq1$, $0.9\leq y+z\leq1.1$, $0.001\leq z\leq0.4$ and $5\leq n\leq7$), KSF/KSNAF, or $(La_{1-x-y}, Eu_x, Ln_y)_2O_2S$ (wherein $0.02\leq x\leq0.50$ and $0\leq y\leq0.50$, Ln=$Y^{3+}$, $Gd^{3+}$, $Lu^{3+}$, $Sc^{3+}$, $Sm^{3+}$ or $Er^{3+}$). In some preferred implementations, the luminescent materials may comprise phosphors comprising one or more of the following materials: $CaAlSiN_3$:Eu, $(Sr,Ca)AlSiN_3$:Eu, $BaMgAl_{10}O_{17}$:Eu, $(Ba,Ca,Sr,Mg)_2SiO_4$:Eu, β-SiAlON, $Lu_3Al_5O_{12}$:Ce, $Eu^{3+}(Cd_{0.9}Y_{0.1})_3Al_5O_{12}:Bi^{3+},Tb^{3+}$, $Y_3Al_5O_{12}$:Ce, $La_3Si_6N_{11}$:Ce, $(La,Y)_3Si_6N_{11}$:Ce, $Ca_2AlSi_3O_2N_5:Ce^{3+}$, $Ca_2AlSi_3O_2N_5:Ce^{3+},Eu^{2+}$, $Ca_2AlSi_3O_2N_5:Eu^{2+}$, $BaMgAl_{10}O_{17}:Eu^{2+}$, $Sr_{4.5}Eu_{0.5}(PO_4)_3Cl$, or $M^1{}_aM^2{}_bM^3{}_cO_d$. (wherein $M^1$=activator element comprising Ce, $M^2$=bivalent metal element, $M^3$=trivalent metal element, $0.0001\leq a\leq0.2$, $0.8\leq b\leq1.2$, $1.6\leq c\leq2.4$ and $3.2\leq d\leq4.8$). In further preferred implementations, the luminescent materials may comprise phosphors comprising one or more of the following materials: $CaAlSiN_3$:Eu, $BaMgAl_{10}O_{17}$:Eu, $Lu_3Al_5O_{12}$:Ce, or $Y_3Al_5O_{12}$:Ce.

Luminescent materials can include an inorganic or organic phosphor; silicate-based phosphors; aluminate-based phosphors; aluminate-silicate phosphors; nitride phosphors; sulfate phosphor; oxy-nitrides and oxy-sulfate phosphors; or garnet materials. The phosphor materials are not limited to any specific examples and can include any phosphor material known in the art with the desired emission spectra in response to the selected excitation light source, i.e. the associated LED or LEDs that produce light that impacts the recipient luminophoric medium. The d50 (average diameter) value of the particle size of the phosphor luminescent materials can be between about 1 μm and about 50 μm, preferably between about 10 μm and about 20 μm, and more preferably between about 13.5 μm, and about 18 μm. Quantum dots are also known in the art. The color of light produced is from the quantum confinement effect associated with the nano-crystal structure of the quantum dots. The energy level of each quantum dot relates directly to the size of the quantum dot. Suitable semiconductor materials for quantum dots are known in the art and may include materials formed from elements from groups II-V, II-VI, or IV-VI in particles having core, core/shell, or core/shells structures and with or without surface-modifying ligands.

Tables 1 and 2 shows aspects of some exemplary luminescent compositions and properties, referred to as Compositions "A"-"F".

TABLE 1

| | | | Exemplary Embodiment | | Suitable Ranges | |
|---|---|---|---|---|---|---|
| | Exemplary Material(s) | density (g/mL) | Emission Peak (nm) | FWHM (nm) | Emission Peak Range (nm) | FWHM Range (nm) |
| Composition "A" | Luag: Cerium doped lutetium aluminum garnet ($Lu_3Al_5O_{12}$) | 6.73 | 535 | 95 | 530-540 | 90-100 |
| Composition "B" | Yag: Cerium doped yttrium aluminum garnet ($Y_3Al_5O_{12}$) | 4.7 | 550 | 110 | 545-555 | 105-115 |

TABLE 1-continued

| | | | Exemplary Embodiment | | Suitable Ranges | |
|---|---|---|---|---|---|---|
| | Exemplary Material(s) | density (g/mL) | Emission Peak (nm) | FWHM (nm) | Emission Peak Range (nm) | FWHM Range (nm) |
| Composition "C" | a 650 nm-peak wavelength emission phosphor: Europium doped calcium aluminum silica nitride ($CaAlSiN_3$) | 3.1 | 650 | 90 | 645-655 | 85-95 |
| Composition "D" | a 525 nm-peak wavelength emission phosphor: GBAM: $BaMgAl_{10}O_{17}$:Eu | 3.1 | 525 | 60 | 520-530 | 55-65 |
| Composition "E" | a 630 nm-peak wavelength emission quantum dot: any semiconductor quantum dot material of appropriate size for desired emission wavelengths | 5.1 | 630 | 40 | 625-635 | 35-45 |
| Composition "F" | a 610 nm-peak wavelength emission quantum dot: any semiconductor quantum dot material of appropriate size for desired emission wavelengths | 5.1 | 610 | 40 | 605-615 | 35-45 |
| Matrix "M" | Silicone binder | 1.1 mg/mm$^3$ | | | | |

TABLE 2

| | | Implementation 1 | | Implementation 2 | |
|---|---|---|---|---|---|
| Designator | Exemplary Material(s) | particle size (d50) | refractive index | particle size | refractive index |
| Composition "A" | Luag: Cerium doped lutetium aluminum garnet ($Lu_3Al_5O_{12}$) | 18.0 μm | 1.84 | 40 μm | 1.8 |
| Composition "B" | Yag: Cerium doped yttrium aluminum garnet ($Y_3Al_5O_{12}$) | 13.5 μm | 1.82 | 30 μm | 1.85 |
| Composition "C" | a 650 nm-peak wavelength emission phosphor: Europium doped calcium aluminum silica nitride ($CaAlSiN_3$) | 15.0 μm | 1.8 | 10 μm | 1.8 |
| Composition "D" | a 525 nm-peak wavelength emission phosphor: GBAM: $BaMgAl_{10}O_{17}$: Eu | 15.0 μm | 1.8 | n/a | n/a |
| Composition "E" | a 630 nm-peak wavelength emission quantum dot: any semiconductor quantum dot material of appropriate size for desired emission wavelengths | 10.0 nm | 1.8 | n/a | n/a |

TABLE 2-continued

| Designator | Exemplary Material(s) | Implementation 1 particle size (d50) | Implementation 1 refractive index | Implementation 2 particle size | Implementation 2 refractive index |
|---|---|---|---|---|---|
| Composition "F" | a 610 nm-peak wavelength emission quantum dot: any semiconductor quantum dot material of appropriate size for desired emission wavelengths | 10.0 nm | 1.8 | n/a | n/a |
| Matrix "M" | Silicone binder | | 1.545 | | 1.545 |

Blends of Compositions A-F can be used in luminophoric mediums (102A/102B/102C/102D) to create luminophoric mediums having the desired saturated color points when excited by their respective LED strings (101A/101B/101C/101D). In some implementations, one or more blends of one or more of Compositions A-F can be used to produce luminophoric mediums (102A/102B/102C/102D). In some preferred implementations, one or more of Compositions A, B, and D and one or more of Compositions C, E, and F can be combined to produce luminophoric mediums (102A/102B/102C/102D). In some preferred implementations, the encapsulant for luminophoric mediums (102A/102B/102C/102D) comprises a matrix material having density of about 1.1 $mg/mm^3$ and refractive index of about 1.545. Other matrix materials having refractive indices of between about 1.4 and about 1.6 can also be used in some implementations. In some implementations, Composition A can have a refractive index of about 1.82 and a particle size from about 18 micrometers to about 40 micrometers. In some implementations, Composition B can have a refractive index of about 1.84 and a particle size from about 13 micrometers to about 30 micrometers. In some implementations, Composition C can have a refractive index of about 1.8 and a particle size from about 10 micrometers to about 15 micrometers. In some implementations, Composition D can have a refractive index of about 1.8 and a particle size from about 10 micrometers to about 15 micrometers. Suitable phosphor materials for Compositions A, B, C, and D are commercially available from phosphor manufacturers such as Mitsubishi Chemical Holdings Corporation (Tokyo, Japan), Intematix Corporation (Fremont, Calif.), EMD Performance Materials of Merck KGaA (Darmstadt, Germany), and PhosphorTech Corporation (Kennesaw, Ga.).

In some implementations, Composition A can be selected from the "BG-801" product series sold by Mitsubishi Chemical Corporation. The BG-801 series is provided as cerium doped lutetium aluminum garnet ($Lu_3Al_5O_{12}$). For some implementations, other phosphor materials are also suitable and can have peak emission wavelengths of between about 530 nm and about 560 nm, FWHM of between about 90 nm and about 110 nm, and particle sizes (d50) of between about 10 μm and about 50 μm.

In some implementations, Composition B can be selected from the "BY-102" or "BY-202" product series sold by Mitsubishi Chemical Corporation. The BY-102 series is provided as cerium doped yttrium aluminum garnet ($Y_3Al_5O_{12}$). The BY-202 series is provided as $(La,Y)_3Si_6N_{11}$:Ce. For some implementations, other phosphor materials are also suitable and can have peak emission wavelengths of between about 545 nm and about 560 nm, FWHM of between about 90 nm and about 115 nm, and particle sizes (d50) of between about 10 μm and about 50 μm.

In some implementations, Composition C can be selected from the "BR-101", "BR-102", or "BR-103" product series sold by Mitsubishi Chemical Corporation. The BR-101 series is provided as europium doped calcium aluminum silica nitride ($CaAlSiN_3$). The BR-102 series is provided as europium doped strontium substituted calcium aluminum silica nitride $(Sr,Ca)AlSiN_3$. The BR-103 series is provided as europium doped strontium substituted calcium aluminum silica nitride $(Sr,Ca)AlSiN_3$. For some implementations, other phosphor materials are also suitable and can have peak emission wavelengths of between about 610 nm and about 650 nm, FWHM of between about 80 nm and about 105 nm, and particle sizes (d50) of between about 5 μm and about 50 μm.

In some implementations, Composition D can be selected from the "VG-401" product series sold by Mitsubishi Chemical Corporation. The VG-401 series is provided as GBAM: $BaMgAl_{10}O_{17}$:Eu. For some implementations, other phosphor materials are also suitable and can have peak emission wavelengths of between about 510 nm and about 540 nm, FWHM of between about 45 nm and about 75 nm, and particle sizes (d50) of between about 5 μm and about 50 μm.

EXAMPLES

General Simulation Method.

Devices having four LED strings with particular color points were simulated. For each device, four LED strings and recipient luminophoric mediums with particular emissions were selected, and spectral power distributions for the resulting four channels (blue, red, yellow/green, and cyan) were calculated.

The calculations were performed with Scilab (Scilab Enterprises, Versailles, France), LightTools (Synopsis, Inc., Mountain View, Calif.), and custom software created using Python (Python Software Foundation, Beaverton, Oreg.). Each LED string was simulated with an LED emission spectrum and excitation and emission spectra of luminophoric medium(s). For luminophoric mediums comprising phosphors, the simulations also included the absorption spectrum and particle size of phosphor particles. The LED strings generating combined emissions within blue, red and yellow/green color regions were prepared using spectra of a LUXEON Z Color Line royal blue LED (product code LXZ1-PR01) of color bin codes 3, 4, 5, or 6 or a LUXEON Z Color Line blue LED (LXZ1-PB01) of color bin code 1 or 2 (Lumileds Holding B.V., Amsterdam, Netherlands). The LED strings generating combined emissions with color points within the cyan regions were prepared using spectra of a LUXEON Z Color Line blue LED (LXZ1-PB01) of color bin code 5 or LUXEON Z Color Line cyan LED (LXZ1-PE01) color bin code 1, 8, or 9 (Lumileds Holding B.V., Amsterdam, Netherlands). Similar LEDs from other manufacturers such as OSRAM GmbH and Cree, Inc. could also be used.

The luminophoric mediums used in the following examples were calculated as combinations of one or more of Compositions A, B, and D and one or more of Compositions C, E, and F as described more fully elsewhere herein. Those of skill in the art appreciate that various combinations of LEDs and luminophoric blends can be combined to generate combined emissions with desired color points on the 1931 CIE chromaticity diagram and the desired spectral power distributions.

Example 1

A semiconductor light emitting device was simulated having four LED strings. A first LED string is driven by a blue LED having peak emission wavelength of approximately 450 nm to approximately 455 nm, utilizes a recipient luminophoric medium, and generates a combined emission of a blue color point with a 1931 CIE chromaticity diagram color point of (0.2625, 0.1763). A second LED string is driven by a blue LED having peak emission wavelength of approximately 450 nm to approximately 455 nm, utilizes a recipient luminophoric medium, and generates a combined emission of a red color point with a 1931 CIE chromaticity diagram color point of (0.5842, 0.3112). A third LED string is driven by a blue LED having peak emission wavelength of approximately 450 nm to approximately 455 nm, utilizes a recipient luminophoric medium, and generates a combined emission of a yellow/green color point with a 1931 CIE chromaticity diagram color point of (0.4482, 0.5258). A fourth LED string is driven by a cyan LED having a peak emission wavelength of approximately 505 nm, utilizes a recipient luminophoric medium, and generates a combined emission of a cyan color point with a 1931 CIE chromaticity diagram color point of (0.3258, 0.5407). Table 3 below shows the spectral power distributions for the blue, red, yellow-green, and cyan color points generated by the device of this Example, with spectral power shown within wavelength ranges in nanometers from 380 nm to 780 nm, with an arbitrary reference wavelength range selected for each color range and normalized to a value of 100.0:

TABLE 3

| | 380-420 | 421-460 | 461-500 | 501-540 | 541-580 | 581-620 | 621-660 | 661-700 | 701-740 | 741-780 |
|---|---|---|---|---|---|---|---|---|---|---|
| Blue | 0.4 | 100.0 | 20.9 | 15.2 | 25.3 | 26.3 | 25.1 | 13.9 | 5.2 | 1.6 |
| Red | 0.0 | 9.6 | 2.0 | 1.4 | 9.0 | 48.5 | 100.0 | 73.1 | 29.5 | 9.0 |
| Yellow-Green | 1.0 | 1.1 | 5.7 | 75.8 | 100.0 | 83.6 | 69.6 | 40.9 | 15.6 | 4.7 |
| Cyan | 0.1 | 0.5 | 53.0 | 100.0 | 65.0 | 41.6 | 23.1 | 11.6 | 4.2 | 0.6 |

Tables 4 and 5 show exemplary luminophoric mediums suitable for the recipient luminophoric mediums for the blue, red, yellow/green, and cyan channels of this Example, using the Compositions A-F from Implementation 1 or Implementation 2 as described in Tables 1 and 2 above.

TABLE 4

| | Volumetric Ratios - Using "Implementation 1" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 1 | | 1.54 | 0.87 | | | | 97.60 |
| Blue Blend 2 | 1.68 | | 1.89 | | | | 96.43 |
| Blue Blend 3 | 1.35 | 0.58 | 1.49 | | | | 96.58 |
| Blue Blend 4 | | | 1.84 | 1.34 | | | 96.82 |
| Blue Blend 5 | | 0.86 | 1.51 | 0.93 | | | 96.69 |
| Blue Blend 6 | 0.89 | | | | 1.73 | 0.35 | 97.03 |
| Blue Blend 7 | | 1.34 | | | 1.11 | | 97.55 |
| Red Blend 1 | | 1.66 | 24.23 | | | | 74.11 |
| Red Blend 2 | 1.96 | | 24.72 | | | | 73.32 |
| Red Blend 3 | 0.00 | 3.43 | 26.48 | | | | 70.10 |
| Red Blend 4 | | | 21.36 | 1.70 | | | 76.94 |
| Red Blend 5 | | 0.80 | 24.49 | 1.22 | | | 73.49 |
| Red Blend 6 | 0.22 | | | | 12.74 | 11.75 | 75.28 |
| Red Blend 7 | | 0.07 | | | 15.34 | 7.90 | 76.70 |
| Yellow/Green Blend 1 | 54.92 | | 1.82 | | | | 43.26 |
| Yellow/Green Blend 2 | 56.18 | 3.90 | 0.07 | | | | 39.86 |
| Yellow/Green Blend 3 | | | 2.49 | 20.51 | | | 77.00 |
| Yellow/Green Blend 4 | | 5.21 | 5.34 | 46.86 | | | 42.59 |
| Yellow/Green Blend 5 | 38.63 | | | | 1.55 | 1.84 | 57.98 |
| Cyan Blend 1 | | 4.45 | 9.16 | | | | 86.38 |
| Cyan Blend 2 | 6.29 | | 11.67 | | | | 82.03 |
| Cyan Blend 3 | 2.03 | 3.16 | 9.94 | | | | 84.86 |
| Cyan Blend 4 | | | 6.30 | 4.42 | | | 89.28 |
| Cyan Blend 5 | | 3.30 | 6.93 | 1.41 | | | 88.36 |

TABLE 4-continued

| | Volumetric Ratios - Using "Implementation 1" Compositions from Tables 1 and 2 | | | | | | |
|---|---|---|---|---|---|---|---|
| | Comp. A | Comp. B | Comp. C | Comp. D | Comp. E | Comp. F | Matrix |
| Cyan Blend 6 | 9.12 | | | | 11.67 | 9.29 | 69.92 |
| Cyan Blend 7 | | 4.82 | | | 9.43 | 6.60 | 79.15 |

TABLE 5

| | Volumetric Ratios - Using "Implementation 2" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 8 | | 1.13 | 1.12 | | | | 97.75 |
| Blue Blend 9 | 0.73 | | 2.38 | | | | 96.89 |
| Blue Blend 10 | 0.1 | 0.14 | 1.6 | | | | 97.16 |
| Red Blend 8 | | 0.58 | 16.23 | | | | 83.19 |
| Red Blend 9 | 0.42 | | 16.63 | | | | 82.95 |
| Red Blend 10 | 1.79 | 3.09 | 17.6 | | | | 77.52 |
| Yellow/Green Blend 6 | 94.48 | 0.04 | 3.51 | | | | 1.97 |
| Cyan Blend 8 | | 3.07 | 3.67 | | | | 93.26 |
| Cyan Blend 9 | 5.32 | | 4.2 | | | | 90.48 |

Example 2

A semiconductor light emitting device was simulated having four LED strings. A first LED string is driven by a blue LED having peak emission wavelength of approximately 450 nm to approximately 455 nm, utilizes a recipient luminophoric medium, and generates a combined emission of a blue color point with a 1931 CIE chromaticity diagram color point of (0.2625, 0.1763). A second LED string is driven by a blue LED having peak emission wavelength of approximately 450 nm to approximately 455 nm, utilizes a recipient luminophoric medium, and generates a combined emission of a red color point with a 1931 CIE chromaticity diagram color point of (0.5842, 0.3112). A third LED string is driven by a blue LED having peak emission wavelength of approximately 450 nm to approximately 455 nm, utilizes a recipient luminophoric medium, and generates a combined emission of a yellow/green color point with a 1931 CIE chromaticity diagram color point of (0.5108, 0.4708). A fourth LED string is driven by a cyan LED having a peak emission wavelength of approximately 505 nm, utilizes a recipient luminophoric medium, and generates a combined emission of a cyan color point with a 1931 CIE chromaticity diagram color point of (0.3258, 0.5407). Table 6 below shows the spectral power distributions for the blue, red, yellow-green, and cyan color points generated by the device of this Example, with spectral power shown within wavelength ranges in nanometers from 380 nm to 780 nm, with an arbitrary reference wavelength range selected for each color range and normalized to a value of 100.0:

TABLE 6

| | 380-420 | 421-460 | 461-500 | 501-540 | 541-580 | 581-620 | 621-660 | 661-700 | 701-740 | 741-780 |
|---|---|---|---|---|---|---|---|---|---|---|
| Blue | 0.3 | 100.0 | 196.1 | 33.0 | 40.3 | 38.2 | 34.2 | 20.4 | 7.8 | 2.3 |
| Red | 0.0 | 157.8 | 2.0 | 1.4 | 9.0 | 48.5 | 100.0 | 73.1 | 29.5 | 9.0 |
| Yellow-Green | 0.0 | 1.0 | 4.2 | 56.6 | 100.0 | 123.4 | 144.9 | 88.8 | 34.4 | 10.5 |
| Cyan | 0.1 | 0.5 | 53.0 | 100.0 | 65.0 | 41.6 | 23.1 | 11.6 | 4.2 | 0.6 |

Tables 7 and 8 show exemplary luminophoric mediums suitable for the recipient luminophoric mediums for the blue, red, yellow/green, and cyan channels of this Example, using the Compositions A-F from Implementation 1 or Implementation 2 as described in Tables 1 and 2 above.

TABLE 7

| | Volumetric Ratios - Using "Implementation 1" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 1 | | 1.54 | 0.87 | | | | 97.59 |
| Blue Blend 2 | | 1.34 | | | 1.11 | | 97.55 |
| Blue Blend 3 | 1.68 | | 1.89 | | | | 96.43 |
| Blue Blend 4 | 1.35 | 0.58 | 1.49 | | | | 96.58 |
| Blue Blend 5 | | | 1.84 | 1.34 | | | 96.82 |
| Blue Blend 6 | | 0.86 | 1.51 | 0.93 | | | 96.69 |
| Blue Blend 7 | 0.89 | | | | 1.73 | 0.35 | 97.03 |
| Red Blend 1 | | 1.66 | 24.23 | | | | 74.11 |
| Red Blend 2 | | 0.07 | | | 15.34 | 7.90 | 76.70 |
| Red Blend 3 | 1.96 | | 24.72 | | | | 73.32 |
| Red Blend 4 | | 3.43 | 26.48 | | | | 70.10 |
| Red Blend 5 | | | 21.36 | 1.70 | | | 76.94 |
| Red Blend 6 | | 0.80 | 24.49 | 1.22 | | | 73.49 |
| Red Blend 7 | 0.22 | | | | 12.74 | 11.75 | 75.28 |
| Yellow/Green Blend 1 | | 50.54 | 0.02 | | | | 49.44 |
| Yellow/Green Blend 2 | | 37.70 | | | 1.40 | 0.61 | 60.28 |
| Yellow/Green Blend 3 | 43.22 | | 15.08 | | | | 41.70 |
| Yellow/Green Blend 4 | | | 6.51 | 19.90 | | | 73.59 |
| Yellow/Green Blend 5 | | 5.01 | 15.89 | 37.71 | | | 41.39 |
| Yellow/Green Blend 6 | 24.41 | | | | 9.45 | 11.02 | 55.11 |
| Cyan Blend 1 | | 4.45 | 9.16 | | | | 86.38 |
| Cyan Blend 2 | | 4.82 | | | 9.43 | 6.60 | 79.15 |
| Cyan Blend 3 | 6.29 | | 11.67 | | | | 82.03 |
| Cyan Blend 4 | 2.03 | 3.16 | 9.94 | | | | 84.86 |
| Cyan Blend 5 | | | 6.30 | 4.42 | | | 89.28 |
| Cyan Blend 6 | | 3.30 | 6.93 | 1.41 | | | 88.36 |
| Cyan Blend 7 | 9.12 | | | | 11.67 | 9.29 | 69.92 |

TABLE 8

| | Volumetric Ratios - Using "Implementation 2" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 8 | 0 | 1.13 | 1.12 | | | | 97.75 |
| Blue Blend 9 | 0.73 | 0 | 2.38 | | | | 96.89 |
| Blue Blend 10 | 0.1 | 0.14 | 1.6 | | | | 98.16 |
| Red Blend 8 | 0 | 0.58 | 16.23 | | | | 83.19 |
| Red Blend 9 | 0.42 | 0 | 16.63 | | | | 82.95 |
| Red Blend 10 | 1.79 | 3.09 | 17.6 | | | | 77.52 |
| Cyan Blend 8 | 0 | 3.07 | 3.67 | | | | 93.26 |
| Cyan Blend 9 | 5.32 | 0 | 4.2 | | | | 90.48 |

Example 3

A semiconductor light emitting device was simulated having four LED strings. A first LED string is driven by a blue LED having peak emission wavelength of approximately 450 nm to approximately 455 nm, utilizes a recipient luminophoric medium, and generates a combined emission of a blue color point with a 1931 CIE chromaticity diagram color point of (0.2219, 0.1755). A second LED string is driven by a blue LED having peak emission wavelength of approximately 450 nm to approximately 455 nm, utilizes a recipient luminophoric medium, and generates a combined emission of a red color point with a 1931 CIE chromaticity diagram color point of (0.5702, 0.3869). A third LED string is driven by a blue LED having peak emission wavelength of approximately 450 nm to approximately 455 nm, utilizes a recipient luminophoric medium, and generates a combined emission of a yellow/green color point with a 1931 CIE chromaticity diagram color point of (0.3722, 0.4232). A fourth LED string is driven by a cyan LED having a peak emission wavelength of approximately 505 nm, utilizes a recipient luminophoric medium, and generates a combined emission of a cyan color point with a 1931 CIE chromaticity diagram color point of (0.3704, 0.5083). Table 9 below shows the spectral power distributions for the blue, red, yellow-green, and cyan color points generated by the device of this Example, with spectral power shown within wavelength ranges in nanometers from 380 nm to 780 nm, with an arbitrary reference wavelength range selected for each color range and normalized to a value of 100.0:

TABLE 9

| | 380-420 | 421-460 | 461-500 | 501-540 | 541-580 | 581-620 | 621-660 | 661-700 | 701-740 | 741-780 |
|---|---|---|---|---|---|---|---|---|---|---|
| Blue | 8.1 | 100.0 | 188.1 | 35.6 | 40.0 | 70.0 | 80.2 | 12.4 | 2.3 | 1.0 |
| Red | 0.7 | 2.1 | 4.1 | 12.2 | 20.5 | 51.8 | 100.0 | 74.3 | 29.3 | 8.4 |
| Yellow-Green | 1.0 | 25.3 | 52.7 | 77.5 | 100.0 | 80.5 | 62.0 | 35.1 | 13.3 | 4.0 |
| Cyan | 0.4 | 1.5 | 55.5 | 100.0 | 65.3 | 59.9 | 57.1 | 35.0 | 13.5 | 4.1 |

Tables 10 and 11 show exemplary luminophoric mediums suitable for the recipient luminophoric mediums for the blue, red, yellow/green, and cyan channels of this Example, using the Compositions A-F from Implementation 1 or Implementation 2 as described in Tables 1 and 2 above.

TABLE 10

| | Volumetric Ratios - Using "Implementation 1" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 1 | | 1.47 | | | | | 98.53 |
| Blue Blend 2 | | 1.39 | | | 0.01 | | 98.60 |
| Blue Blend 3 | 1.84 | | 0.55 | | | | 97.60 |
| Blue Blend 4 | 1.54 | 0.55 | 0.07 | | | | 97.84 |
| Blue Blend 5 | | | 0.79 | 1.49 | | | 97.72 |
| Blue Blend 6 | | 0.74 | 0.31 | 1.33 | | | 97.63 |
| Blue Blend 7 | 1.21 | | | | 0.66 | | 98.13 |
| Red Blend 1 | | 11.66 | 21.77 | | | | 66.57 |
| Red Blend 2 | | 5.59 | | | 17.46 | 7.21 | 69.74 |
| Red Blend 3 | 13.17 | | 25.45 | | | | 61.38 |
| Red Blend 4 | 6.47 | 7.75 | 24.90 | | | | 60.88 |
| Red Blend 5 | | | 16.55 | 8.34 | | | 75.11 |
| Red Blend 6 | | 2.37 | 24.60 | 11.89 | | | 61.13 |
| Red Blend 7 | 4.57 | | | | 16.51 | 12.47 | 66.44 |
| Yellow/Green Blend 1 | 16.75 | | 2.44 | | | | 80.81 |
| Yellow/Green Blend 2 | 32.98 | 8.23 | 0.06 | | | | 58.73 |
| Yellow/Green Blend 3 | | | 2.90 | 7.46 | | | 89.64 |
| Yellow/Green Blend 4 | | 0.79 | 4.25 | 17.43 | | | 77.53 |
| Yellow/Green Blend 5 | 10.62 | | | | 1.98 | 2.24 | 85.17 |
| Cyan Blend 1 | | | 16.88 | | | | 83.12 |
| Cyan Blend 2 | | 2.29 | | | 16.58 | 8.02 | 73.11 |
| Cyan Blend 3 | 5.00 | | 16.18 | | | | 78.82 |
| Cyan Blend 4 | 0.43 | 2.74 | 15.68 | | | | 81.14 |
| Cyan Blend 5 | | | 12.05 | 1.75 | | | 86.20 |
| Cyan Blend 6 | | 0.03 | 10.52 | 2.79 | | | 86.66 |
| Cyan Blend 7 | 4.98 | | | | 14.42 | 12.74 | 67.86 |

TABLE 11

| | Volumetric Ratios - Using "Implementation 2" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 8 | | 1.06 | | | | | 98.94 |
| Blue Blend 9 | 0.88 | | 0.64 | | | | 98.48 |
| Blue Blend 10 | 2.92 | 1.62 | | | | | 95.46 |
| Red Blend 8 | | 4.02 | 13.36 | | | | 82.62 |
| Red Blend 9 | 3.25 | | 15.67 | | | | 81.08 |
| Red Blend 10 | 16.56 | 15.37 | 16.88 | | | | 51.19 |
| Yellow Blend 6 | 39.09 | 3.06 | 1.16 | | | | 56.69 |
| Cyan Blend 8 | | 2.0 | 6.71 | | | | 91.29 |
| Cyan Blend 9 | 3.83 | | 6.51 | | | | 89.66 |

Example 4

A semiconductor light emitting device was simulated having four LED strings. A first LED string is driven by a blue LED having peak emission wavelength of approximately 450 nm to approximately 455 nm, utilizes a recipient luminophoric medium, and generates a combined emission of a blue color point with a 1931 CIE chromaticity diagram color point of (0.2387, 0.1692). A second LED string is driven by a blue LED having peak emission wavelength of approximately 450 nm to approximately 455 nm, utilizes a recipient luminophoric medium, and generates a combined emission of a red color point with a 1931 CIE chromaticity diagram color point of (0.5563, 0.3072). A third LED string is driven by a blue LED having peak emission wavelength of approximately 450 nm to approximately 455 nm, utilizes a recipient luminophoric medium, and generates a combined emission of a yellow/green color point with a 1931 CIE chromaticity diagram color point of (0.4494, 0.5161). A fourth LED string is driven by a cyan LED having a peak emission wavelength of approximately 505 nm, utilizes a recipient luminophoric medium, and generates a combined emission of a cyan color point with a 1931 CIE chromaticity diagram color point of (0.3548, 0.5484). Table 12 below shows the spectral power distributions for the blue, red, yellow-green, and cyan color points generated by the device of this Example, with spectral power shown within wavelength ranges in nanometers from 380 nm to 780 nm, with an arbitrary reference wavelength range selected for each color range and normalized to a value of 100.0:

TABLE 12

| | 380-420 | 421-460 | 461-500 | 501-540 | 541-580 | 581-620 | 621-660 | 661-700 | 701-740 | 741-780 |
|---|---|---|---|---|---|---|---|---|---|---|
| Blue | 1.9 | 100.0 | 34.4 | 32.1 | 40.5 | 29.0 | 15.4 | 5.9 | 2.8 | 1.5 |
| Red | 14.8 | 10.5 | 6.7 | 8.7 | 8.7 | 102.8 | 100.0 | 11.0 | 1.5 | 1.1 |
| Yellow-Green | 1.1 | 2.3 | 5.9 | 61.0 | 100.0 | 85.0 | 51.0 | 12.6 | 3.2 | 1.0 |
| Cyan | 0.7 | 1.6 | 39.6 | 100.0 | 80.4 | 53.0 | 24.9 | 9.5 | 3.3 | 1.2 |

Tables 13 and 14 show exemplary luminophoric mediums suitable for the recipient luminophoric mediums for the blue, red, yellow/green, and cyan channels of this Example, using the Compositions A-F from Implementation 1 or Implementation 2 as described in Tables 1 and 2 above.

TABLE 13

| | Volumetric Ratios - Using "Implementation 1" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 1 | | 1.49 | 0.13 | | | | 98.38 |
| Blue Blend 2 | | 1.46 | | | 0.15 | | 98.39 |
| Blue Blend 3 | 1.63 | | 1.12 | | | | 97.24 |
| Blue Blend 4 | 1.36 | 0.53 | 0.71 | | | | 97.41 |
| Blue Blend 5 | | | 1.24 | 1.34 | | | 97.43 |
| Blue Blend 6 | | 0.75 | 0.84 | 1.04 | | | 97.37 |
| Blue Blend 7 | 0.99 | | | | 1.27 | | 97.74 |
| Red Blend 1 | | 2.18 | 20.26 | | | | 77.55 |
| Red Blend 2 | | 0.40 | | | 13.83 | 5.57 | 80.20 |
| Red Blend 3 | 2.57 | | 20.93 | | | | 76.50 |
| Red Blend 4 | 0.68 | 2.15 | 22.07 | | | | 75.10 |
| Red Blend 5 | | | 17.50 | 2.11 | | | 80.40 |
| Red Blend 6 | | 1.62 | 20.45 | 0.85 | | | 77.07 |
| Red Blend 7 | 0.47 | | | | 11.38 | 9.48 | 78.67 |
| Yellow/Green Blend 1 | 46.13 | | 3.33 | | | | 50.54 |
| Yellow/Green Blend 2 | 74.85 | 15.25 | 0.09 | | | | 9.81 |
| Yellow/Green Blend 3 | | | 2.99 | 18.14 | | | 78.87 |
| Yellow/Green Blend 4 | | 5.55 | 5.59 | 38.75 | | | 50.11 |
| Yellow/Green Blend 5 | 32.93 | | | | 2.40 | 3.11 | 61.56 |
| Cyan Blend 1 | | 12.31 | 8.97 | | | | 78.72 |
| Cyan Blend 2 | | 18.36 | | | 7.33 | 1.03 | 73.28 |
| Cyan Blend 3 | 17.39 | | 14.53 | | | | 68.08 |
| Cyan Blend 4 | 1.58 | 16.41 | 6.74 | | | | 75.27 |
| Cyan Blend 5 | | | 4.42 | 6.30 | | | 89.28 |
| Cyan Blend 6 | | 9.00 | 1.00 | 8.02 | | | 81.98 |
| Cyan Blend 7 | 25.77 | | | | 11.28 | 8.70 | 54.26 |

TABLE 14

| | Volumetric Ratios - Using "Implementation 2" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 8 | | 1.06 | | | | | 98.94 |
| Blue Blend 9 | 0.76 | | 1.45 | | | | 97.79 |
| Blue Blend 10 | 0.08 | 0.12 | 1.52 | | | | 98.28 |
| Red Blend 8 | | 0.74 | 14.13 | | | | 85.13 |
| Red Blend 9 | 0.6 | | 14.65 | | | | 84.75 |
| Red Blend 10 | 3.07 | 3.52 | 14.75 | | | | 78.66 |
| Cyan Blend 8 | | 6.31 | 1.13 | | | | 92.56 |
| Cyan Blend 9 | 10.0 | | 2.5 | | | | 87.50 |

Example 5

A semiconductor light emitting device was simulated having four LED strings. A first LED string is driven by a blue LED having peak emission wavelength of approximately 450 nm to approximately 455 nm, utilizes a recipient luminophoric medium, and generates a combined emission of a blue color point with a 1931 CIE chromaticity diagram color point of (0.2524, 0.223). A second LED string is driven by a blue LED having peak emission wavelength of approximately 450 nm to approximately 455 nm, utilizes a recipient luminophoric medium, and generates a combined emission of a red color point with a 1931 CIE chromaticity diagram color point of (0.5941, 0.3215). A third LED string is driven by a blue LED having peak emission wavelength of approximately 450 nm to approximately 455 nm, utilizes a recipient luminophoric medium, and generates a combined emission of a yellow/green color point with a 1931 CIE chromaticity diagram color point of (0.4338, 0.5195). A fourth LED string is driven by a cyan LED having a peak emission wavelength of approximately 505 nm, utilizes a recipient luminophoric medium, and generates a combined emission of a cyan color point with a 1931 CIE chromaticity diagram color point of (0.3361, 0.5257). Table 15 below shows the spectral power distributions for the blue, red, yellow-green, and cyan color points generated by the device of this Example, with spectral power shown within wavelength ranges in nanometers from 380 nm to 780 nm, with an arbitrary reference wavelength range selected for each color range and normalized to a value of 100.0:

TABLE 15

| | 380-420 | 421-460 | 461-500 | 501-540 | 541-580 | 581-620 | 621-660 | 661-700 | 701-740 | 741-780 |
|---|---|---|---|---|---|---|---|---|---|---|
| Blue | 1.9 | 100.0 | 34.4 | 32.1 | 40.5 | 29.0 | 15.4 | 5.9 | 2.8 | 1.5 |
| Red | 0.2 | 8.5 | 3.0 | 5.5 | 9.5 | 60.7 | 100.0 | 1.8 | 0.5 | 0.3 |
| Yellow-Green | 0.8 | 5.6 | 6.3 | 73.4 | 100.0 | 83.8 | 48.4 | 19.5 | 6.5 | 2.0 |
| Cyan | 0.2 | 1.4 | 58.6 | 100.0 | 62.0 | 47.5 | 28.2 | 6.6 | 1.8 | 0.6 |

Tables 16 and 17 show exemplary luminophoric mediums suitable for the recipient luminophoric mediums for the blue, red, yellow/green, and cyan channels of this Example, using the Compositions A-F from Implementation 1 or Implementation 2 as described in Tables 1 and 2 above.

TABLE 16

| | Volumetric Ratios - Using "Implementation 1" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 1 | | 2.29 | | | | | 97.70 |
| Blue Blend 2 | | 2.46 | | | 0.15 | | 97.39 |
| Blue Blend 3 | 3.01 | | 0.99 | | | | 95.99 |
| Blue Blend 4 | 2.34 | 1.01 | 0.29 | | | | 96.35 |
| Blue Blend 5 | | | 1.25 | 2.20 | | | 96.55 |
| Blue Blend 6 | | 1.25 | 0.60 | 2.09 | | | 96.06 |
| Blue Blend 7 | 1.88 | | | | 1.16 | | 96.96 |
| Red Blend 1 | | 2.12 | 26.06 | | | | 71.82 |
| Red Blend 2 | | 0.24 | | | 16.36 | 9.03 | 74.37 |
| Red Blend 3 | 2.43 | | 26.68 | | | | 70.89 |
| Red Blend 4 | 1.02 | 1.64 | 28.61 | | | | 68.72 |
| Red Blend 5 | | | 22.60 | 2.22 | | | 75.19 |
| Red Blend 6 | | 1.11 | 26.37 | 1.45 | | | 71.07 |
| Red Blend 7 | 0.38 | | | | 13.79 | 12.99 | 72.84 |
| Yellow/Green Blend 1 | 42.76 | | 1.82 | | | | 55.43 |
| Yellow/Green Blend 2 | 44.06 | 3.54 | 0.05 | | | | 52.35 |

TABLE 16-continued

| | Volumetric Ratios - Using "Implementation 1" Compositions from Tables 1 and 2 | | | | | | |
|---|---|---|---|---|---|---|---|
| | Comp. A | Comp. B | Comp. C | Comp. D | Comp. E | Comp. F | Matrix |
| Yellow/Green Blend 3 | | | 2.60 | 16.60 | | | 80.80 |
| Yellow/Green Blend 4 | | 3.59 | 4.91 | 38.01 | | | 53.50 |
| Yellow/Green Blend 5 | 30.44 | | | | 1.49 | 1.87 | 66.20 |
| Cyan Blend 1 | | 1.51 | 11.87 | | | | 86.62 |
| Cyan Blend 2 | | 2.55 | | | 10.92 | 9.29 | 77.25 |
| Cyan Blend 3 | 2.06 | | 12.75 | | | | 85.19 |
| Cyan Blend 4 | | 3.42 | 10.40 | | | | 86.17 |
| Cyan Blend 5 | | | 8.17 | 2.54 | | | 89.29 |
| Cyan Blend 6 | | 0.63 | 1.67 | 8.85 | | | 88.85 |
| Cyan Blend 7 | 4.97 | | | | 12.58 | 10.32 | 72.12 |

TABLE 17

| | Volumetric Ratios - Using "Implementation 2" Compositions from Tables 1 and 2 | | | | | | |
|---|---|---|---|---|---|---|---|
| | Comp. A | Comp. B | Comp. C | Comp. D | Comp. E | Comp. F | Matrix |
| Blue Blend 8 | | 1.42 | 0.03 | | | | 98.55 |
| Blue Blend 9 | 1.25 | | 1.2 | | | | 97.55 |
| Blue Blend 10 | 0.135 | 0.135 | 1.080 | | | | 98.65 |
| Red Blend 8 | | 0.74 | 17.04 | | | | 82.22 |
| Red Blend 9 | 0.58 | | 17.52 | | | | 81.90 |
| Red Blend 10 | 2.3 | 3.97 | 18.94 | | | | 74.79 |
| Cyan Blend 8 | | 2.01 | 5.38 | | | | 92.61 |
| Cyan Blend 9 | 3.65 | | 5.55 | | | | 90.80 |

Those of ordinary skill in the art will appreciate that a variety of materials can be used in the manufacturing of the components in the devices and systems disclosed herein. Any suitable structure and/or material can be used for the various features described herein, and a skilled artisan will be able to select an appropriate structures and materials based on various considerations, including the intended use of the systems disclosed herein, the intended arena within which they will be used, and the equipment and/or accessories with which they are intended to be used, among other considerations. Conventional polymeric, metal-polymer composites, ceramics, and metal materials are suitable for use in the various components. Materials hereinafter discovered and/or developed that are determined to be suitable for use in the features and elements described herein would also be considered acceptable.

When ranges are used herein for physical properties, such as molecular weight, or chemical properties, such as chemical formulae, all combinations, and subcombinations of ranges for specific exemplar therein are intended to be included.

The reflector body 10 is a modular component which can be utilized with a wide variety of LCAs. In some instances LCAs can be replaced or changed without disturbing the reflector body or associated LEDs.

Each cavity is generally conical and in some instances frustoconical, ellipsoidal or paraboloidal. Each cavity has a separate annular interior wall 58, and a common annular exterior wall 70. The interior wall may be constructed of a highly reflective material such as plastic and metals which may include coatings of highly reflective materials, PTFE (polytetrafluoethylene), Spectralan™, Teflon™ or any metal or plastic coated with TiO2(Titanium dioxide), Al2O3(Aluminum oxide), BaSo4(Barium Sulfide) or other suitable material. In some exemplary implementations operation includes the reflective unit (with affixed LCAs) being fixed on a predetermined arrangement over LEDs 2000 in clusters 2002 of two or more LEDs. The LEDs are mounted on a work surface 1000 such as a PCB or mounted as chip on board, chip on ceramic or other suitable work surface to manage heat and electrical requirements and hold the LEDs. The open top of each cavity terminates in peripheral ring 20. A vent 22 is formed between the tops of the cavities. The shared internal top 12 is preferably also formed of a reflective material to direct light forward. The shared internal top meets the common interior annular wall 110 forming an interface at connection 77. Between two connections are angled light mixing member 115 which mix light from at least two cavities as the reflective surface directs the light upward. Above the shared internal top is the common interior annular wall which also blends and mixes lights from the LEDs in each of the four cavities. A LED cluster and DLCA in a cavity may also be referred to as a channel and the light exiting that structure may be referred to as light from a channel.

The wavelength of light from a given channel will depend on the LEDs selected and the DLCA. The color and uniformity of the light exiting the unit is determined at least in part by the mixing via the common interior annular wall 11 and the angled light mixing members.

The illustration of four cavities is not a limitation; those of ordinary skill in the art will recognize that a two, three, four, five or more reflective cavity device is within the scope of this disclosure. Moreover, those of ordinary skill in the art will recognize that the specific size and shape of the reflective cavities in the unitary body may be predetermined to be different volumes and shapes; uniformity of reflective cavities for a unitary unit is not a limitation of this disclosure.

A diffuser 80 may be added over the top peripheral ring 20 of the unit. The diffuser may be glass or plastic and may also be coated or embedded with Phosphors. The diffuser functions to diffuse at least a portion of the illumination exiting the unit to improve uniformity of the illumination.

Figure 3A:
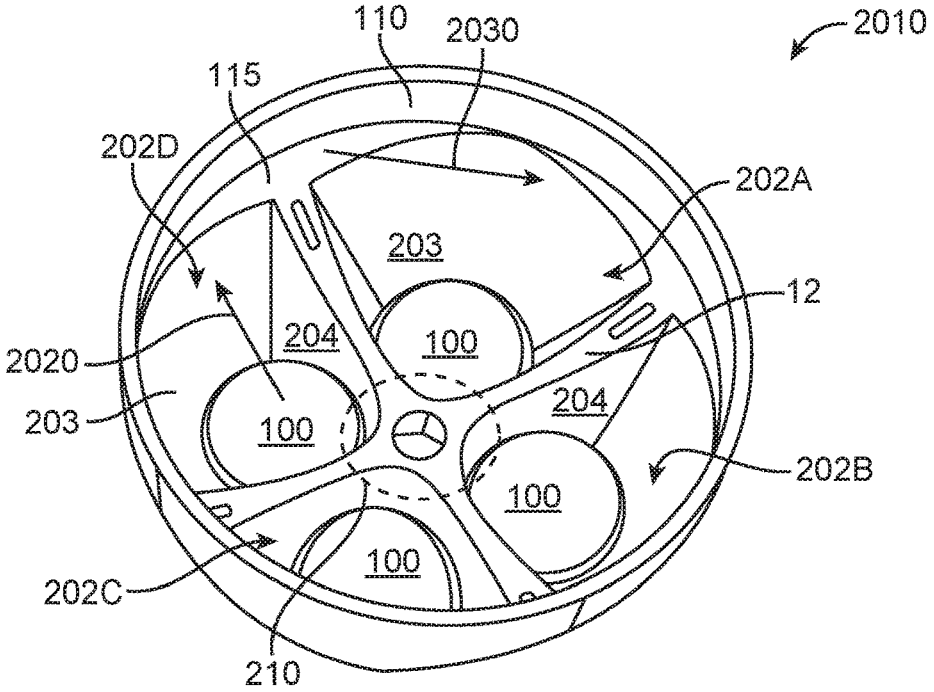
FIGS. 3A and 3B illustrate a zoned optical cup (ZOC).
Figure 3B:
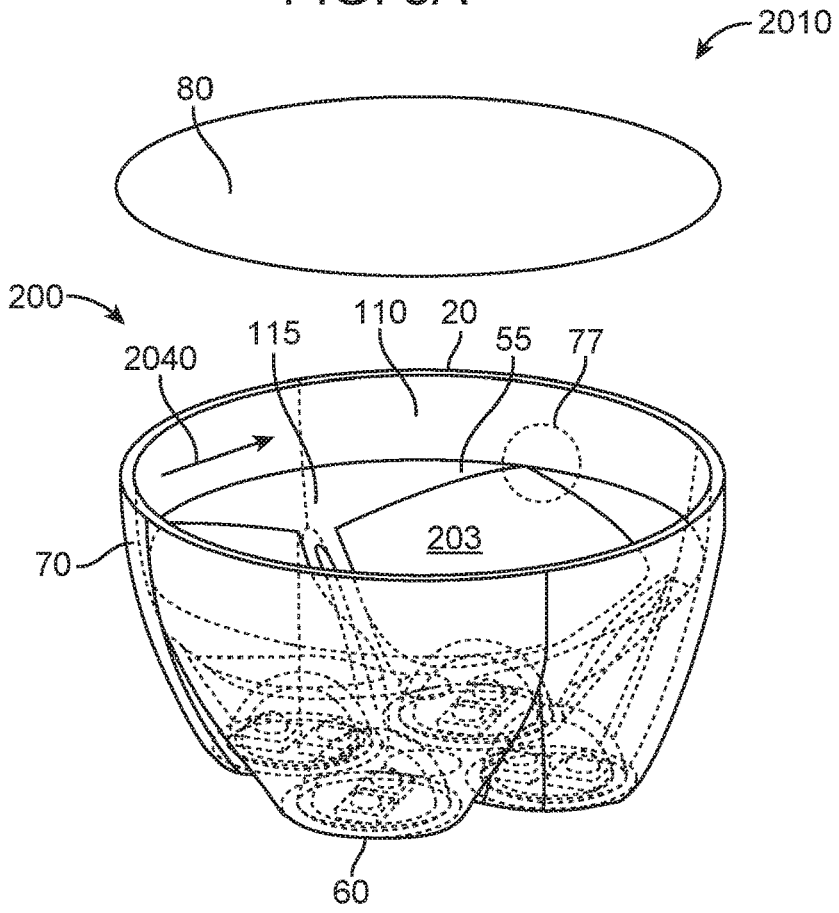

FIGS. 3A and 3B illustrate another reflective unit 200 having a common outer annular wall 70 and four internal cavities 202A-202D. The cavities are shown as having a complex annular wall having a first curved wall 203 and second curved wall 204 wherein each wall is a partial frustoconical, ellipsoidal or paraboloidal generally conical with a decreased radius near the open bottom 60 compared to the open top 55. The non-homogeneous relationship of the walls is to provide a more acute angle near the common center 210 of the common center 210 of the unit. The non-homogeneous wall structures act to direct light in general the same forward direction when light exits the DLCA and enters each cavity (202A-202D).

The shared internal top 12 is preferably also formed of a reflective material to direct light forward. The shared internal top meets the common interior annular wall 110 at connection 77. Between two connections are angled light mixing member 115 which mix light from at least two cavities as the reflective surface directs the light upward. Above the shared internal top is the common interior annular wall which also blends and mixes lights from each channel.

At least a portion of the altered wavelengths 2020 light will reflect off the angled light mixing member 115 which blends light from at least two DLCAs in at least two cavities thereby forming the first mixed light 2030. At least a portion of the first mixed light 2030 will reflect off the common interior annular wall 110 thereby forming a second mixed light output 2040. At least a portion of the altered wavelengths 2020 light can reflect off the common interior annular wall 110 thereby also forming second mixed light output 2040.

A diffuser 80 may be added over the top peripheral ring 20 of the unit. The diffuser may be glass or plastic and may also be coated or embedded with Phosphors. The diffuser functions to diffuse at last a portion of the illumination exiting the unit to improve uniformity of the illumination from the ZOC.

Figure 4:
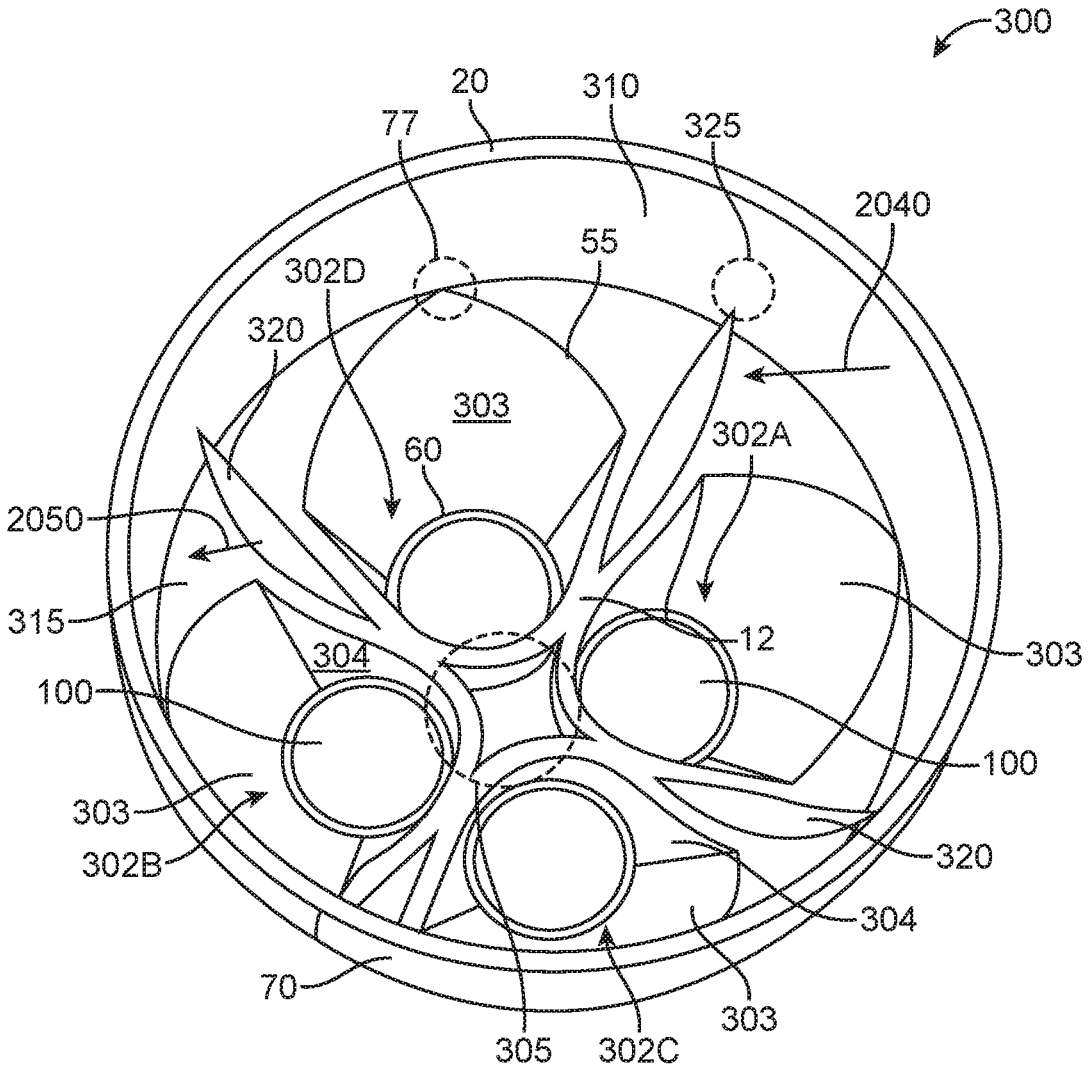
FIGS. 4-6 illustrate a zoned optical cup (ZOC).

FIG. 4 illustrates another reflective unit 300 having a common outer annular wall 70 and four internal cavities 302A-302D. The cavities are shown as having a complex annular wall having a first curved wall 303 and second curved wall 304 wherein each wall is a partial frustoconical, ellipsoidal or paraboloidal generally conical with a decreased radius near the open bottom 60 compared to the open top 55. The non-homogeneous relationship of the walls is to provide a more acute angle near the common center 305 of the common center 305 of the unit. The non-homogeneous wall structures act to direct light in general the same forward direction when light exits the LCA and enters each cavity (302A-302D) forming a ZOC.

The shared internal top 12 is preferably also formed of a reflective material to direct light forward. The shared internal top meets the common interior annular wall 310 at connection 77. Between two connections are angled light mixing member 315 which mixes light from at least two cavities as the reflective surface directs the light upward. A series of light mixing ribs (LMRs) 320 span from the shared internal top 12 through the light mixing member 315 and terminate at an interface 325 on the common interior annular wall 310. The LMRs direct channel light as well as light mixed by other regions of the unit upwards which may include towards the diffuser 80 (not shown in this illustration). The common interior annular wall 310 also blends and mixes lights from each channel.

At least a portion of the altered wavelengths 2020 light reflects off the angled light mixing member 315 forming the first mixed light 2030. At least a portion of the first mixed light 2030 will reflect off the common interior annular wall 110 thereby forming a second mixed light output 2040. At least a portion of the altered wavelengths 2020 light reflects off the off the common interior annular wall 110 thereby forming a second mixed light output 2040.

At least a portion of the altered wavelengths 2020 of light from at least one DLCA reflects off a light mixing rib (LMRs) 320 forming the third mixed light 2050.

At least a portion of the altered wavelengths 2020 light from LEDs reflect off one or more of the common interior annular wall 110, the angled light mixing member 315 and a light mixing rib 320.

Figure 5:
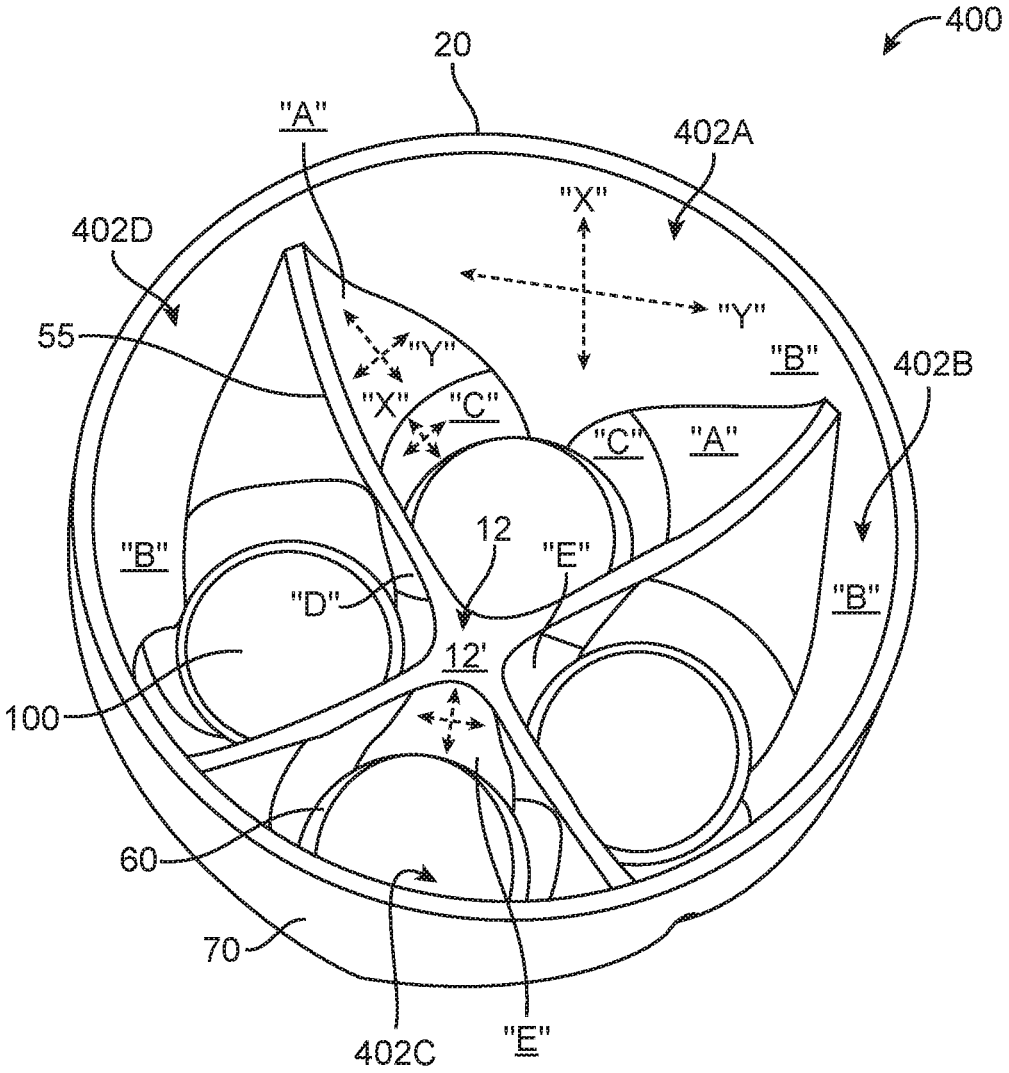

FIG. 5 illustrates another reflective unit 400 having a common outer annular wall 70 and four internal cavities 402A-402D. The cavities are shown as having a complex interior annular surface each having a compilation of one or more of curved sections "A"-"E" forming the wall structure. The complex structure forms a generally conical shape with a decreased radius near the open bottom 60 compared to the open top 55. The wall sections are shaped in combination to provide directing of illumination from the DLCA upward and mixing of the light from different channels by directing some of the illumination from each channel off center. The shared internal top 12 is preferably also formed of a reflective material to direct light forward. A diffuser 80 (not shown in this illustration) may be placed at the peripheral ring 20 forming a ZOC.

Figure 6:
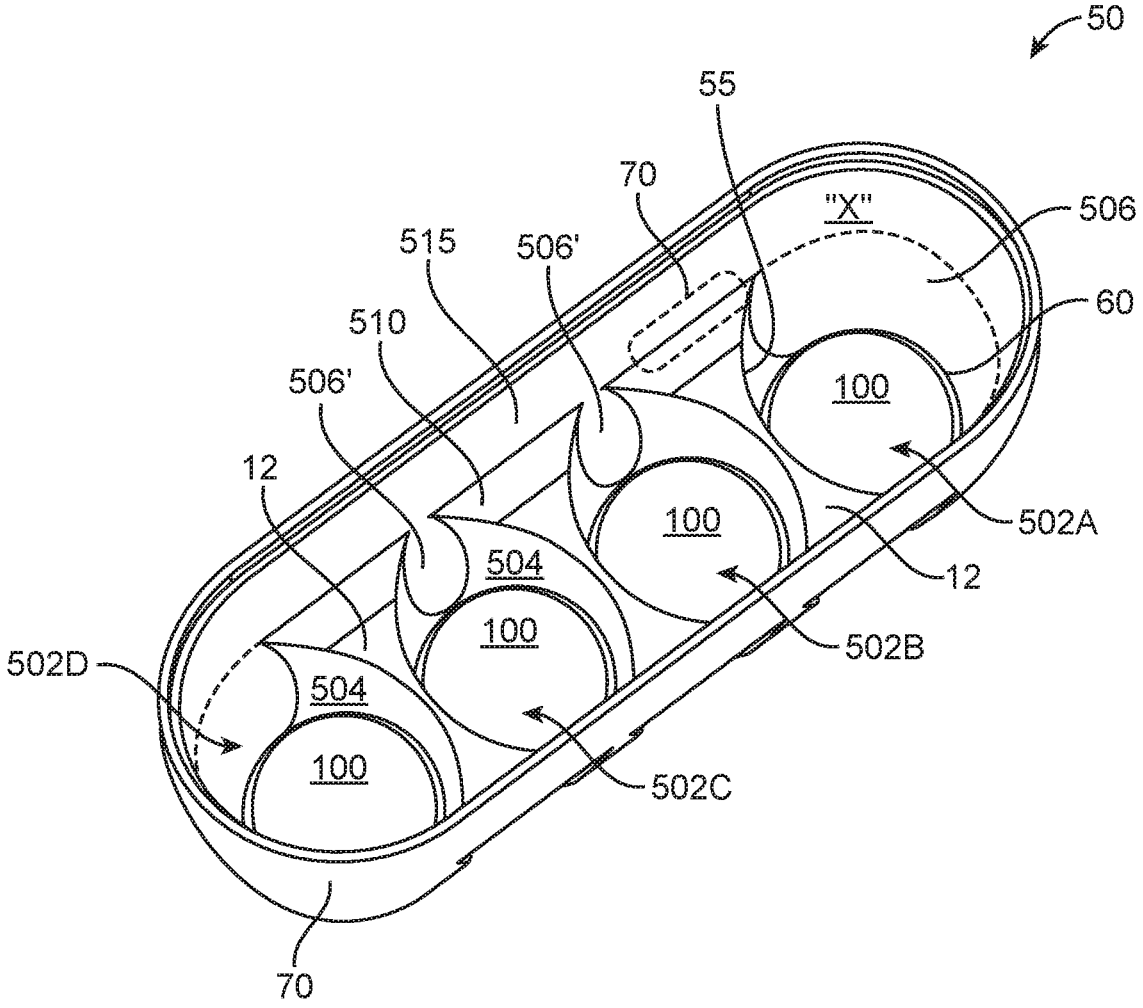

FIG. 6 illustrates another reflective unit 500 having a common outer annular wall 70 and four linear aligned internal cavities 502A-502D. The cavities are non-homogeneous. Cavities 502A and 502D each have an internal curved wall 504 and utilize a portion of the common reflector interior wall 506. Cavities 502B and 502C are formed of two mirror image walls 504 and 504' facing each other and having a portion of the common reflector interior wall 506' interposed between the two mirrored walls.

The shared internal top 12 is preferably also formed of a reflective material to direct light forward. The shared internal top has a light mixing wall 510 which meets the common interior annular wall 506 at connection 77. The angled light mixing member 510 which mixes light from at least two cavities as the reflective surface directs the light upward. A light mixing member 515 forms the upper portion "X" of the common internal wall of the unit.). The common interior annular wall 515 also blends and mixes lights from each. A diffuser 80 (not shown in this illustration) is preferably added above the peripheral ring 20 forming a ZOC.

It will be understood that various aspects or details of the invention(s) may be changed without departing from the scope of the disclosure and invention. It is not exhaustive and does not limit the claimed inventions to the precise form disclosed. Furthermore, the foregoing description is for the purpose of illustration only, and not for the purpose of limitation. Modifications and variations are possible in light of the above description or may be acquired from practicing the invention. The claims and their equivalents define the scope of the invention(s).

What is claimed:

1. A zoned light mixing method, the method comprising:

placing a plurality of strings of LEDs in a unitary body with multiple reflective cavities configured to mix the output from the LEDs, each string of LEDs associated with each of the multiple reflective cavities;

passing light from a first LED string through a first luminophoric medium comprised of one or more luminescent materials and matrix in a first ratio for a first combined light in a blue color range on 1931 CIE diagram;

passing light from a second LED string through a second luminophoric medium comprised of one or more luminescent materials and matrix in a second ratio for a second combined light in a red color range on 1931 CIE diagram;

passing light from a third LED string through a third luminophoric medium comprised of one or more luminescent materials and matrix in a third ratio for a third combined light in a yellow/green color range on 1931 CIE diagram;

passing light from a fourth LED string through a fourth luminophoric medium comprised of one or more luminescent materials and matrix in a fourth ratio for a fourth combined light in a cyan color range on 1931 CIE diagram; and, mixing the first, second, third, and fourth combined light together.

2. The method of claim 1, wherein the luminescent materials within each of the first, second, third, and fourth luminophoric mediums comprise one or more of a first type of luminescent material that emits light at a peak emission between about 515 nm and 590 nm in response to the associated LED string emission; and, one or more of a second type of luminescent material that emits light at a peak emission between about 590 nm and about 700 nm in response to the associated LED string emission.

3. The method of claim 2, wherein the one or more of the first type of luminescent materials comprise $BaMgAl_{10}O_{17}$:Eu, $Lu_3Al_5O_{12}$:Ce, $(La,Y)_3Si_6N_{11}$:Ce, or $Y_3Al_5O_{12}$:Ce, the one or more of the second type of luminescent materials comprise $CaAlSiN_3$:Eu, $(Sr,Ca)AlSiN_3$, or a semiconductor quantum dot.

4. The method of claim 2, wherein

At least one of the first, second, and third LED strings each comprise an LED with peak wavelength of between about 385 nm and about 470 nm; and, the fourth LED string comprises an LED with a peak wavelength of between about 485 nm and about 520 nm.

5. The method of claim 4, wherein the first luminophoric medium comprises up to about 20% by volume of $Y_3Al_5O_{12}$:Ce.

6. The method of claim 4, wherein the second luminophoric medium comprises up to about 15% by volume of $Y_3Al_5O_{12}$:Ce.

7. The method of claim 4, wherein the third luminophoric medium comprises up to about 55% by volume of $Y_3Al_5O_{12}$:Ce.

8. The method of claim 4, wherein the fourth luminophoric medium comprises up to about 20% by volume of $Y_3Al_5O_{12}$:Ce.

9. The method of claim 4, wherein the first luminophoric medium comprises up to about 15% by volume of $Lu_3Al_5O_{12}$:Ce.

10. The method of claim 4, wherein the second luminophoric medium comprises up to about 15% by volume of $Lu_3Al_5O_{12}$:Ce.

11. The method of claim 4, wherein the third luminophoric medium comprises up to about 99% by volume of $Lu_3Al_5O_{12}$:Ce.

12. The method of claim 11, wherein the fourth luminophoric medium comprises up to about 30% by volume of $Lu_3Al_5O_{12}$:Ce.

13. The method of claim 4, wherein the first luminophoric medium comprises up to about 7.5% by volume of $BaMgAl_{10}O_{17}$:Eu.

14. The method of claim 4, wherein the second luminophoric medium comprises up to about 15% by volume of $BaMgAl_{10}O_{17}$:Eu.

15. The method of claim 4, wherein the third luminophoric medium comprises up to about 85% by volume of $BaMgAl_{10}O_{17}$:Eu.

16. The method of claim 4, wherein the fourth luminophoric medium comprises up to about 10% by volume of $BaMgAl_{10}O_{17}$:Eu.

17. The method of claim 4, wherein the first luminophoric medium comprises up to about 5% by volume of $CaAlSiN_3$.

18. The method of claim 4, wherein the second luminophoric medium comprises up to about 55% by volume of $CaAlSiN_3$.

19. The method of claim 4, wherein the third luminophoric medium comprises up to about 20% by volume of $CaAlSiN_3$.

20. The method of claim 4, wherein the fourth luminophoric medium comprises up to about 20% by volume of $CaAlSiN_3$.

21. A method of generating white light, the method comprising passing light from a first LED string through a first luminophoric medium comprised of one or more luminescent materials and matrix in a first ratio for a first combined light in a blue color range on 1931 CIE diagram, the first combined light formed within a first reflective cavity;

passing light from a second LED string through a second luminophoric medium comprised of one or more luminescent materials and matrix in a second ratio for a second combined light in a red color range on 1931 CIE diagram, the second combined light formed within a second reflective cavity;

passing light from a third LED string through a third luminophoric medium comprised of one or more luminescent materials and matrix in a third ratio for a third combined light in a yellow/green color range on 1931 CIE diagram, the third combined light formed within a third reflective cavity;

passing light from a fourth LED string through a fourth luminophoric medium comprised of one or more luminescent materials and matrix in a fourth ratio for a fourth combined light in a cyan color range on 1931 CIE diagram, the fourth combined light formed within a fourth reflective cavity; and, mixing the first, second, third, and fourth combined light together.

* * * * *